US006996867B2

(12) United States Patent
Boso et al.

(10) Patent No.: US 6,996,867 B2
(45) **Date of Patent: *Feb. 14, 2006**

(54) INCREASED HEIGHT INFLATABLE SUPPORT SYSTEM

(75) Inventors: Karen L. Boso, Woodstock, IL (US); Chen Ching-Chin, Taipei (TW)

(73) Assignee: Aero Products International, Inc., Wauconda, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/751,783

(22) Filed: Jan. 5, 2004

(65) Prior Publication Data

US 2004/0194219 A1 Oct. 7, 2004

Related U.S. Application Data

(63) Continuation of application No. 09/918,561, filed on Aug. 1, 2001, now Pat. No. 6,701,559.

(51) Int. Cl.
*A47C 27/10* (2006.01)

(52) U.S. Cl. ..... 5/739; 5/711; 5/713; 5/424

(58) Field of Classification Search ..... 5/706, 5/710, 713, 732, 739, 424
See application file for complete search history.

(56) References Cited

U.S. PATENT DOCUMENTS

| | | | | | |
|---|---|---|---|---|---|
| 1,576,211 | A | * | 3/1926 | O'Kane | 5/710 |
| 2,604,641 | A | * | 7/1952 | Reed | 5/710 |
| 2,614,272 | A | * | 10/1952 | Morner | 5/655.3 |
| 2,672,628 | A | | 3/1954 | Spanel | |
| 2,703,770 | A | | 3/1955 | Melzer | |
| 3,772,717 | A | * | 11/1973 | Yuen et al. | 5/422 |
| 4,091,482 | A | | 5/1978 | Malcolm | |
| 4,594,743 | A | * | 6/1986 | Owen et al. | 5/111 |
| 4,890,344 | A | | 1/1990 | Walker | |
| 5,117,517 | A | | 6/1992 | Su | |
| 5,163,196 | A | | 11/1992 | Graebe et al. | |
| 5,170,522 | A | | 12/1992 | Walker | |
| D343,980 | S | | 2/1994 | Torchia | |
| 5,367,726 | A | | 11/1994 | Chaffee | |
| 5,493,742 | A | | 2/1996 | Klearman | |
| 5,598,593 | A | * | 2/1997 | Wolfe | 5/710 |
| 5,689,845 | A | | 11/1997 | Sobieralski | |
| 5,746,873 | A | | 5/1998 | Graf | |
| 5,903,941 | A | | 5/1999 | Shafer et al. | |
| D414,976 | S | | 10/1999 | Su et al. | |
| 5,963,997 | A | | 10/1999 | Hagopian | |
| 6,009,580 | A | | 1/2000 | Caminade et al. | |
| 6,076,214 | A | * | 6/2000 | Klimenko | 5/710 |
| 6,131,219 | A | | 10/2000 | Roberts | |
| 6,189,168 | B1 | | 2/2001 | Graebe | |
| 6,240,584 | B1 | * | 6/2001 | Perez et al. | 5/713 |
| 6,287,095 | B1 | | 9/2001 | Saputo et al. | |
| 6,446,289 | B1 | | 9/2002 | Su et al. | |
| 6,483,264 | B1 | | 11/2002 | Shafer et al. | |

(Continued)

*Primary Examiner*—Michael Trettel
(74) *Attorney, Agent, or Firm*—Brinks Hofer Gilson & Lione

(57) ABSTRACT

An inflatable mattress is provided having an upper and a lower inflatable support chamber which are arranged in a substantially vertical manner. Each inflatable support chamber has a top layer, a bottom layer, and a side gusset. At least one inflatable stabilizing component is attached at the bottom layer of the lower inflatable support chamber and is of a height less than the height of the lower inflatable support chamber.

19 Claims, 5 Drawing Sheets

U.S. PATENT DOCUMENTS

| | | | | |
|---|---|---|---|---|
| 6,701,559 | B1 * | 3/2004 | Boso et al. | 5/739 |
| 2001/0044969 | A1 | 11/2001 | Chaffee | |
| 2002/0116765 | A1 | 8/2002 | Smith et al. | |
| 2002/0184710 | A1 | 12/2002 | Chaffee | |
| 2002/0194678 | A1 | 12/2002 | Chung | |
| 2003/0028971 | A1 | 2/2003 | Chaffee | |
| 2003/0192123 | A1 | 10/2003 | Chaffee | |
| 2003/0200611 | A1 | 10/2003 | Chaffee | |

* cited by examiner

Fig. 3
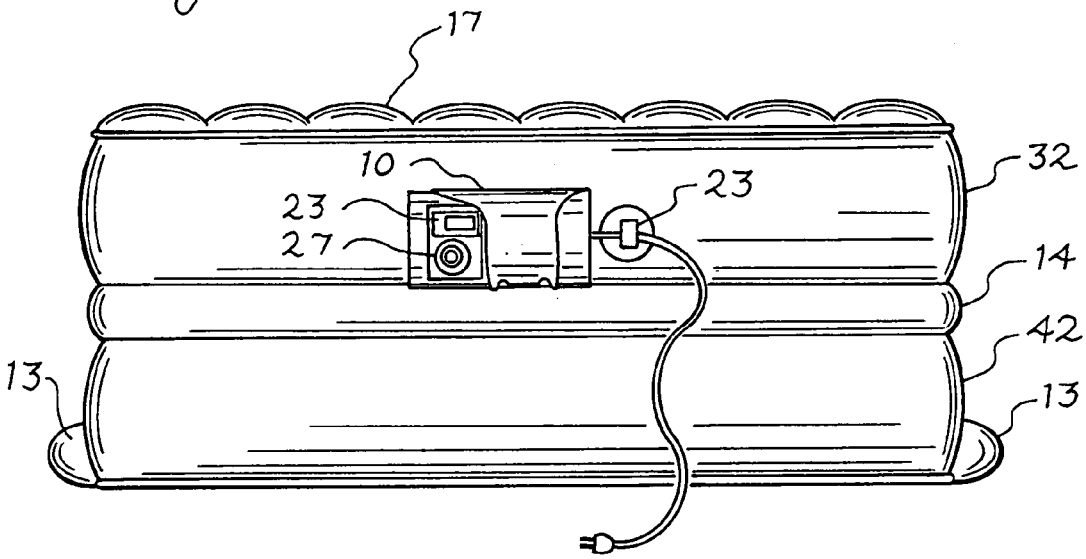
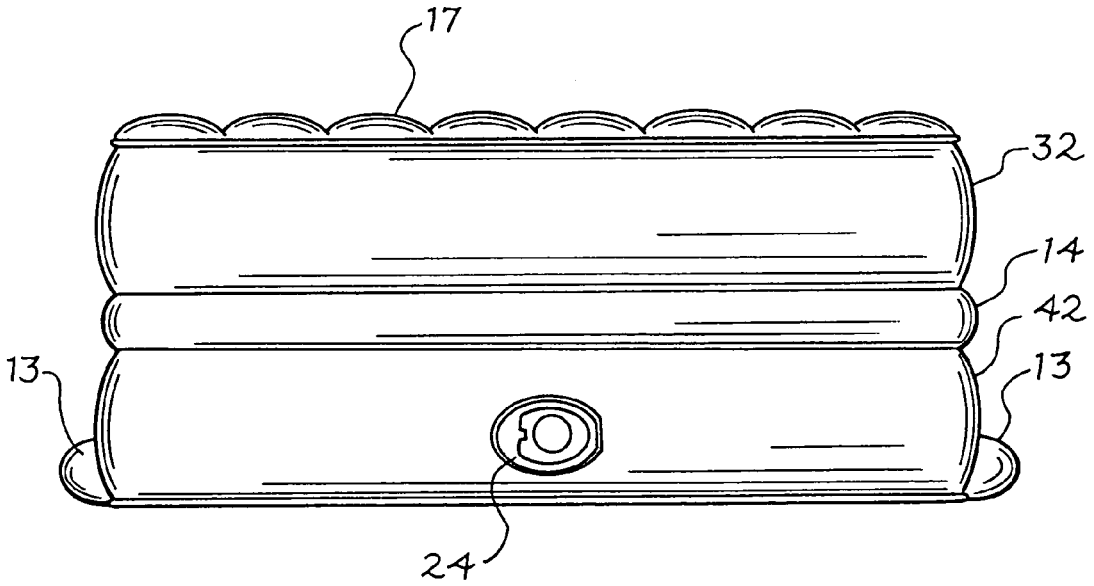
Fig. 4

INCREASED HEIGHT INFLATABLE SUPPORT SYSTEM

RELATED APPLICATION DATA

This application is a continuation of U.S. Ser. No. 09/918,561, filed Aug. 1, 2001, now U.S. Pat. No. 6,701,559, and entitled "Increased Height Inflatable Support System," the entire disclosure of which is hereby incorporated by reference.

FIELD OF THE INVENTION

The present invention relates to the field of inflatable support systems, which may include air mattresses and inflation controls thereof.

BACKGROUND OF THE INVENTION

Most everyone has faced the need for an extra bed or mattress at some time in their life. Air mattresses, originally introduced many years ago, have allowed homeowners and others to provide their guests with a surface more comfortable than sleeping on the floor, while not imposing the same storage requirements as traditional mattresses.

While air mattresses are a significant improvement over sleeping on the ground or curled up on a sofa, the mattresses still have many problems. For example, air mattress designs were clunky and uncomfortable, the manufacturing techniques and materials used resulted in poor air retention, the inflation and deflation systems employed with such mattresses often required significant time and effort, and the mattresses tended to provide only marginal support.

Some issued patents, such as U.S. Pat. No. 4,977,633, issued to Robert B. Chaffee on Dec. 18, 1990 ("the Chaffee patent"), and U.S. Pat. No. 5,960,495, issued to Yaw-Yuan Hsu, et al. on Oct. 5, 1999 ("the Hsu patent"), have attempted to address some of these shortcomings. By way of example, the Chaffee patent teaches the use of a large, manually operated pressure release valve to speed deflation. The Chaffee patent also teaches the inclusion of a small cylinder around which a deflated bed can be rolled, further simplifying deflation. This same arrangement also allows the bed to automatically unroll while being inflated, which also simplifies the inflation process. The Chaffee patent also illustrates the inclusion of an electric motor, which speeds the inflation process.

The Hsu patent attempts to address some of the comfort problems typically associated with air mattresses. The Hsu patent utilizes tube beams inside a mattress to provide additional lateral load support. These tube beams are separate structures which are added to the inside of the mattress and are attached to the upper and lower mattress surfaces through a sinusoidal sealing pattern in an attempt to provide further rigidity to the mattress.

A person sleeping on mattresses such as those described in the Chaffee and Hsu patents still has the perception of sleeping on the floor. Furthermore, getting into and out of such a bed can be difficult, especially for an elderly or disabled person.

A solution to this problem is to provide a mattress that approximates the dimensions of a traditional bed. But, such inflatable mattresses have a propensity to roll over. Rollovers are not only a problem with inflatable mattresses, but with all lightweight support surfaces, such as inflatable furniture. Some in the prior art, such as U.S. Pat. No. 6,161,902, issued to Marvin S. Lieberman on Dec. 19, 2000 (the Lieberman patent); the "Game Day Minute Chair" by Aero Products International, Inc. of Wauconda, Ill.; and the "Retro Air Chair" by Intex Recreation Corporation of Long Beach, Calif., have used multiple inflatable cylindrical tubes to improve the stability of inflatable chairs.

While the stabilization methods employed in the prior art can improve overall chair stability, each has shortcomings, especially when applied to other support systems. For example, the Lieberman patent teaches the installation of a "U" shaped inflatable tube underneath the front of a chair and a small inflatable tube extending along and immovably attached to the rear base of the chair. Each of these tubes is also inflated separately from and to a higher pressure than the body of the chair. The increased pressure of these tubes strengthens the base of the chair, thus reducing the likelihood of rollover. While this approach has some merit, the introduction of separately inflatable tubes means added work for the consumer, who must move an inflation device from one valve to another until the chair is properly filled.

The Game Day Minute Chair and Retro Air Chair apply alternative stabilization techniques. In both cases, two small inflatable stabilizer bars, no more than fifteen inches long and approximately six inches in diameter when inflated, are attached to the base of the chair to increase the surface area covered by the chair. These stabilizer bars are attached to the chair through narrow, short inflator tubes (three and one half inches long by one and one half inch wide in the case of the Game Day Minute Chair). The inflator tubes allow the stabilizer bars to be in fluid communication with the chair bodies and to fill with air as the chair is filled. The increased surface area created by the combination of the inflator tubes and the stabilizer bars provides more stability by distributing the weight over a larger area.

As with the Lieberman patent, the shape and position of the stabilizer bars employed on these chairs also strengthens the chair body where the stabilizer bars contact the chair. However, such strengthening is only provided to areas adjacent to the tubes. While this may be practical for inflatable support systems with smaller weight bearing surfaces, such as chairs, a few, relatively short stabilizer bars will not provide stability for larger inflatable support systems, such as inflatable mattresses.

An additional problem faced by inflatable support systems of the prior art is structural stability of the sides of the support system. The shape of the side tends to distort as weight is applied at or near the edge of the support system. Such distortion can cause a person to slip or fall from the support surface, increasing the risk of injury to a user. This problem becomes increasingly significant as the height of the support system is increased. A means of improving the structural stability of the side of the mattress is therefore preferable as height is increased.

SUMMARY OF THE INVENTION

In one embodiment of the present invention, an inflatable mattress is provided. The inflatable mattress has an upper and a lower inflatable support chamber which are arranged in a substantially vertical manner. Each inflatable support chamber has a top layer, a bottom layer, and a side gusset. At least one inflatable stabilizing component is attached at the bottom layer of the lower inflatable support chamber and is of a height less than the height of the lower inflatable support chamber.

In a second embodiment of the present invention, an inflatable mattress is provided. The inflatable mattress has an upper and a lower inflatable support chamber which are arranged in a substantially vertical manner. Each inflatable support chamber has a top layer, a bottom layer, and a side gusset. An inflatable reinforcing chamber is attached to the upper and lower inflatable support chambers.

In a third embodiment of the present invention, an inflatable mattress is provided. The inflatable mattress has a support system comprised of an upper and a lower inflatable support chamber arranged in a substantially vertical manner. Each of the inflatable support chambers has a top layer, a bottom layer, and a side gusset. At least one inflatable stabilizing component is attached to the side gusset of the lower inflatable support chamber and is of a height less than the height of the lower inflatable support chamber.

In a fourth embodiment of the present invention, an inflatable mattress is provided. The inflatable mattress comprises two or more inflatable chambers wherein each inflatable chamber comprises a plurality of elongated parallel channels that extend in a longitudinal direction and that are in fluid communication with one another. The inflatable mattress also has at least one stabilizing component flexibly attached to the support system on one or more sides.

In a fifth embodiment of the present invention, an inflatable mattress is provided. The inflatable mattress has at least two or more inflatable chambers wherein each inflatable chamber comprises a plurality of elongated parallel channels that extend in a longitudinal direction and that are in fluid communication with one another. A means for increasing the surface area across which weight added to the support system can be distributed is also provided.

BRIEF DESCRIPTION OF THE DRAWINGS

The accompanying drawings which are included to provide a further understanding of the invention and are incorporated in and constitute a part of this specification, and illustrate embodiments of the invention and together with the description serve to explain the principles of the invention.

In the drawings:

FIG. 3 is a front planar view of a mattress embodiment of the present invention;

FIG. 4 is a rear planar view of a mattress embodiment of the present invention;

DETAILED DESCRIPTION OF THE PREFERRED EMBODIMENT

Reference will now be made in detail to the preferred embodiments of the present invention, examples of which are illustrated in the accompanying drawings.

Figure 1:
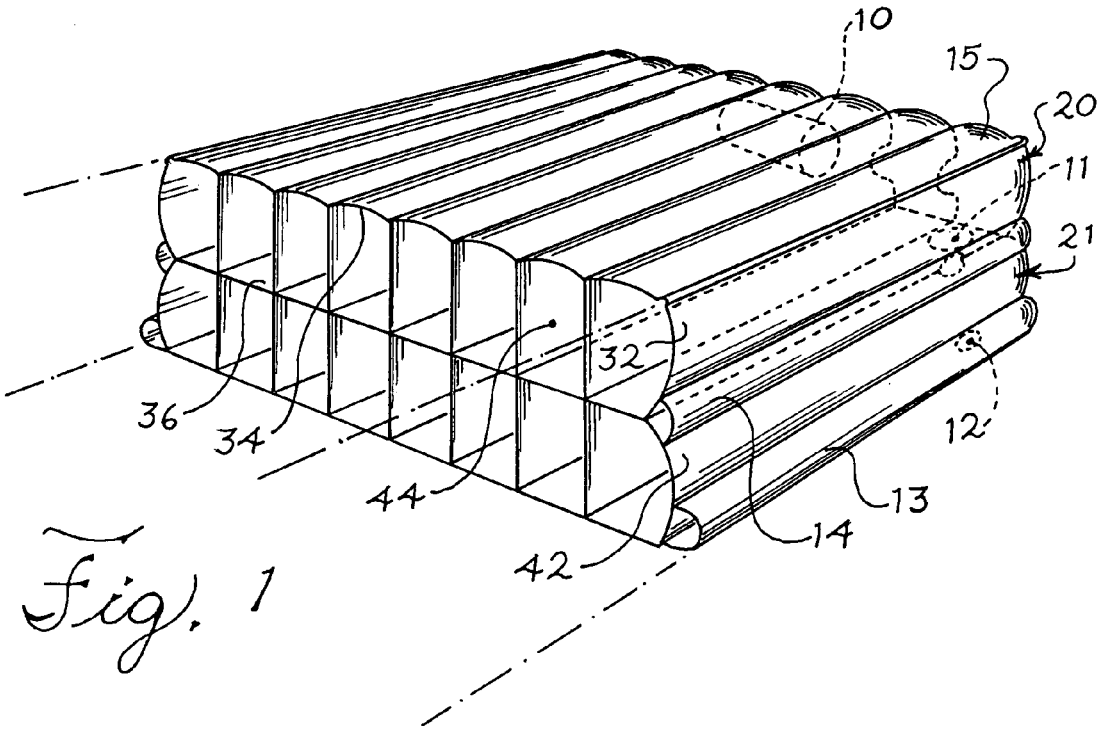
FIG. 1 is a perspective view of the internal structure of a mattress embodiment of the present invention.
Figure 7:
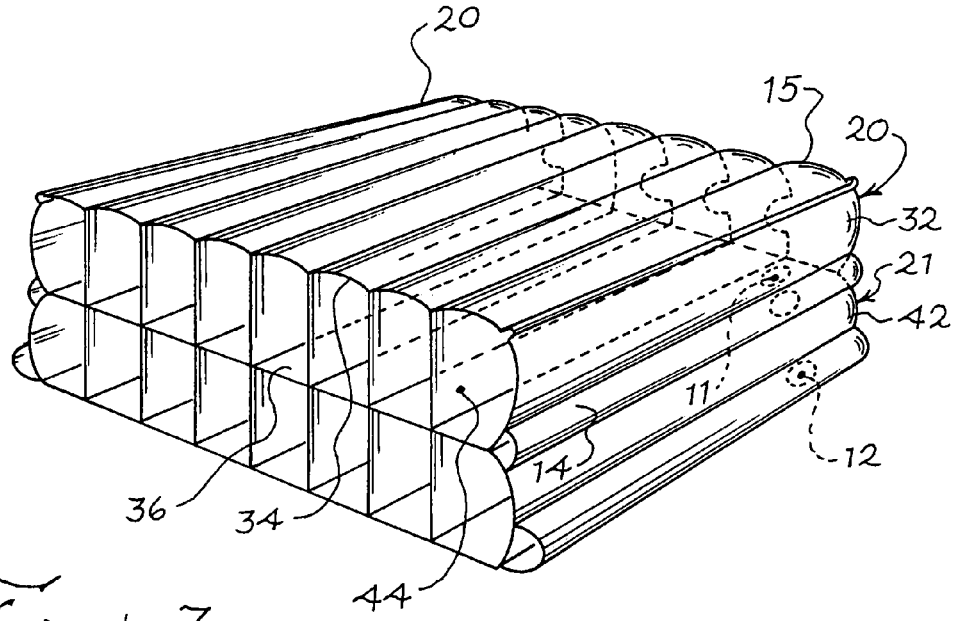
FIG. 7 is a perspective view of an alternative mattress embodiment of the present invention employing multiple upper support chambers.

FIG. 1 is a perspective view of the internal structure of an inflatable mattress embodiment of the present invention. FIG. 1 illustrates an embodiment comprising an inflatable support system including two support chambers 20, 21, stacked vertically. In the embodiment illustrated in FIG. 1, the upper support chamber 20 is constructed with side gussets 32 approximately ten inches high, which connect to top 34 and bottom 36 layers. The lower support chamber 21 is constructed from a top layer 38, a bottom layer 40 and a side gusset 42 that is approximately fifteen inches high. It should be clear to one skilled in the art that alternative side gusset heights and chamber arrangements could be substituted without departing from the spirit and scope of the present invention. By way of example, FIG. 7 illustrates the use of multiple upper support chambers. As is more clearly shown in FIG. 9, the upper support chamber 20 rests on top of the lower support chamber 21. The top layer 38 of the lower support chamber 21 is in contact with the bottom layer 36 of the upper support chamber 20.

As FIG. 1 illustrates, a motorized pump 10 is attached to upper support chamber 20. The pump 10 should be powerful enough to fill the entire support system with a gas or fluid, such as air, such that the upper support chamber 20 can provide comfortable support to a user. Inflation of the support system can begin by pressing a button 23 on or near the pump 10, as is illustrated in FIG. 3. The pump 10 may automatically stop inflating the support system when the pressure within the support system reaches a limit selectable by a user. In addition, should a user desire to gradually decrease the pressure within the support system, a user simply activates a push-button valve 27, illustrated in FIG. 3. The pump 10 may also monitor support system air pressure and automatically add additional air if the pressure falls below a level selected by a user.

Air entering the upper support chamber 20 may flow into the lower support chamber 21 through a series of reinforced openings 11. These openings 11 are defined in the top layer 38 of the lower support chamber 21 and the bottom layer 36 of the upper support chamber 20. The openings 11 are substantially aligned such that air may flow between them. In the embodiment illustrated in FIG. 1, additional openings 12 allow the inflatable stabilizing components 13 to be in fluid communication with the lower support chamber 21.

Figure 9:
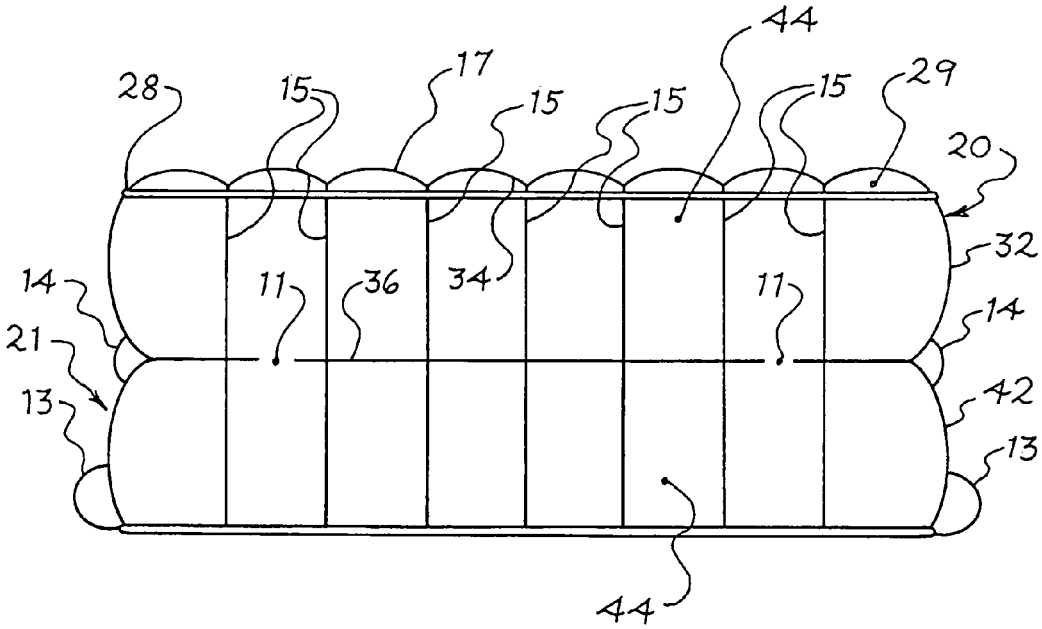
FIG. 9 is a cross-sectional view of the mattress embodiment of the present invention illustrated in FIG. 4 including a pillow-top chamber.

Additionally, a reinforcing chamber 14 is included in the support system. The reinforcing chamber 14 is best illustrated in FIG. 9. This reinforcing chamber 14 runs circumferentially around the support system at the junction between the upper support chamber 20 and the lower support chamber 21. The reinforcing chamber 14 may be attached to the side gussets 32, 42 of the upper 20 and lower 21 inflatable support chambers, respectively.

Again referring to FIG. 1, the upper support chamber 20, lower support chamber 21, inflatable stabilizing component(s) 13, and reinforcing chamber 14 are preferably made from heavy weight (preferably 18 gauge) polyvinylchloride (PVC) or other watertight and airtight material. PVC may be attached to PVC or other material by electronically "welding" the PVC to the other material, although other attachment means, such through a chemical bond or by stitching edges of each sheet together, may also be used. Such an attachment means may be used, for example, to join the top of a chamber with the side of a chamber or to add a layer of fabric, padding, flocking, or other material (collectively "fabric") to the PVC.

Within the upper support chamber 20 and the lower support chamber 21, PVC strips 15 can be attached to the inner surface of the top layer 34, 38 and bottom layer 36, 40 of each chamber 20, 21. Such PVC strips 15 create elongated parallel channels 44, which help to shape and structurally reinforce the upper support chamber 20 and the lower support chamber 21. It should be apparent to one skilled in the art that alternative chamber support architectures, such as the "coil construction" technique known in the art, may be employed without departing from the spirit or scope of the present invention.

Figure 2:
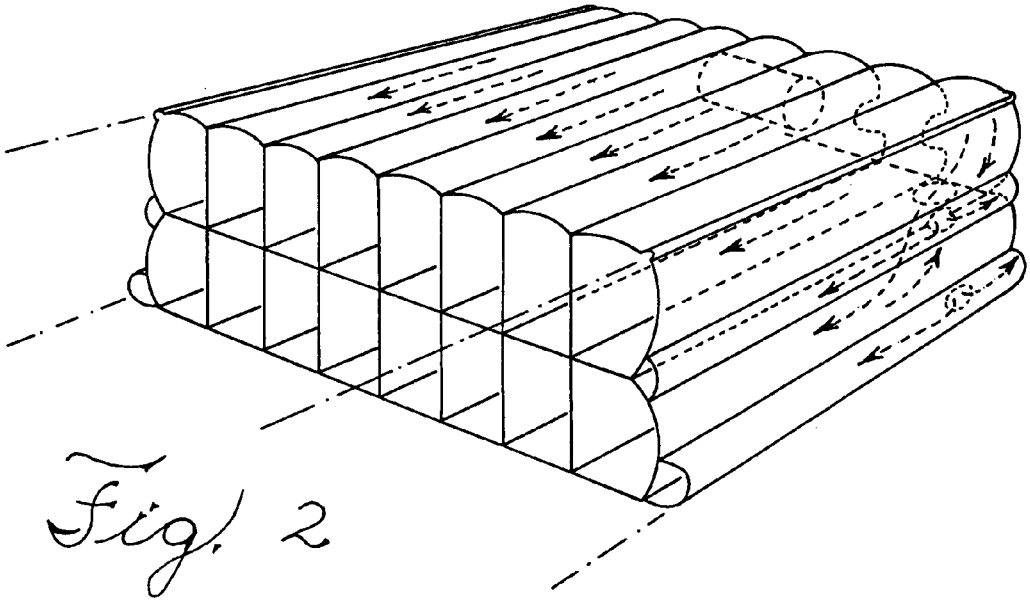
FIG. 2 is a perspective view of the internal structure of a mattress embodiment of the present invention also illustrating air flow inside said mattress.

FIG. 2 is a perspective view of the internal structure of a mattress embodiment of the present invention, also illustrating the flow of air or other fluid inside said mattress. As FIG. 2 illustrates, air enters the support system at the pump 10 and travels through the channels 44 created by PVC strips 15 within the upper support chamber 20. The PVC strips 15 are preferably shaped such that air is able to flow past the ends of the PVC strips 15, thereby allowing air to circulate within the upper support chamber 20 and the lower support chamber 21.

As the upper support chamber 20 inflates, air can enter the lower support chamber 21 through the openings 11. The embodiment shown uses four such openings 11, each of which is approximately three quarters of an inch in diameter. Each opening 11 is substantially centered within a circular weld four inches in diameter, where such a weld can also serve to attach the upper support chamber 20 to the lower support chamber 21. It should be obvious to one skilled in the art that other opening arrangements, including, but not limited to, fewer openings of a larger size, or more openings of a smaller size, may also be used.

While such alternative opening arrangements may be used, a preferred placement of the openings 11 is important for proper durability and inflation. Locating the openings 11 in the second channel from the end has proved to generate the least number of tears in the PVC strips 15 while still allowing rapid inflation of both the upper support chamber 20 and the lower support chamber 21.

Figure 8:
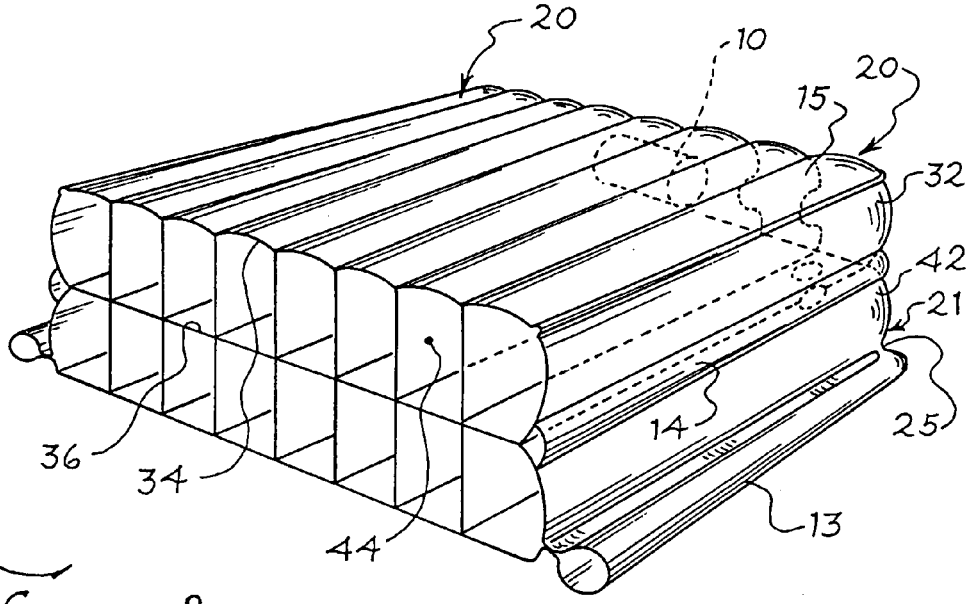
FIG. 8 is a perspective view of an alternative mattress embodiment of the present invention in which the illustrated stabilizer bar is in fluid communication with the lower support chamber through a series of tubes.

As the lower support chamber 21 inflates, air can also flow into the stabilizing component(s) 13. The stabilizing component(s) 13 are preferably of a height less than that of the lower support chamber 21. In the embodiment illustrated in FIG. 2, air can flow into and out of the stabilizing component(s) 13 through a series of openings 12. FIG. 8 illustrates a preferred stabilizing component 13 embodiment, in which the stabilizing component(s) 13 are bars that are in fluid communication with the lower support chamber 21 through two short tubes 25. While the position of the tubes 25 does not impact the ability of the stabilizing component(s) 13 to inflate, in the embodiment shown, the tubes 25 are preferably located approximately one and one half inches from the ends of the stabilizing component(s) 13.

As illustrated in both FIG. 2 and FIG. 8, the stabilizing component(s) 13 are flexibly attached to the side gusset 42 of the lower support chamber 21, preferably near the bottom of the side gusset 42. Alternatively, the stabilizing component(s) 13 may be attached directly to the bottom layer 40 of the lower support chamber 21. In the embodiments shown, the stabilizing component(s) 13 are attached to opposite sides of the lower support chamber 21.

Figure 6:
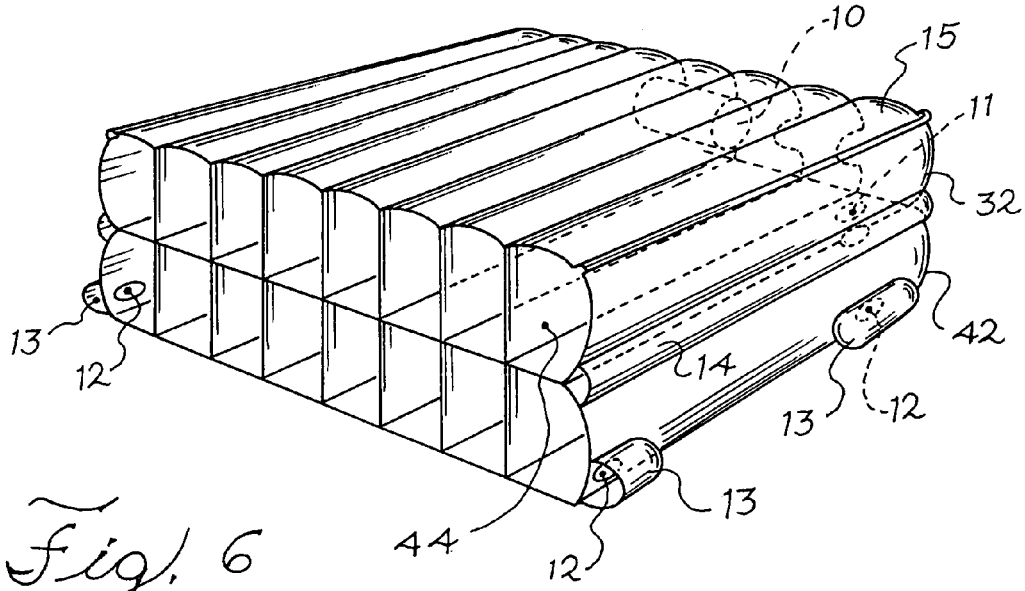
FIG. 6 is a perspective view of an alternative mattress embodiment of the present invention employing multiple stabilizer bars.

While FIG. 2 illustrates the use of a single stabilizing component 13 on opposing sides of the support system, each having of a length substantially equal to the length of the support system, alternative stabilizing component arrangements can also be envisioned. For example, FIG. 6 provides an alternative perspective view of a mattress embodiment of the present invention employing multiple stabilizing component(s) 13 on each opposing side of the support system. In another alternative embodiment, a single stabilizing component can extend circumferentially around the lower support chamber 21. Such a stabilizing component can be a series of smaller stabilizing component(s) in fluid communication with each other, or a single stabilizing component. It should be noted that, unlike the stabilizer bars used in the prior art, the stabilizing component arrangements employed by the present invention provide stabilization along almost the entire length of at least one side of the support system.

FIG. 2 also illustrates a preferred inflation means for the reinforcing chamber 14. As FIG. 2 illustrates, the reinforcing chamber 14 is in fluid communication with the lower support chamber 21 through a series of openings 16 and runs circumferentially around the support system. In a preferred embodiment, the openings 16 are approximately three quarters of an inch in diameter, and are substantially centered in reinforced PVC.

In an alternative embodiment, the reinforcing chamber 14 may receive air from the upper support chamber 20. In still another embodiment, the reinforcing chamber 14 may be in fluid communication with both the upper support chamber 20 and the lower support chamber 21. In yet another embodiment, the reinforcing chamber 14 may be separately inflatable, thereby allowing the reinforcing chamber 14 to be inflated to a pressure greater than the pressure in the remaining support system.

FIG. 3 is a front planar view of a mattress embodiment of the present invention. As FIG. 3 illustrates an embodiment with one or more layers of fabric 17 added to the outside of the upper support chamber 20. While it is preferred that the fabric 17 be laminated to upper support chamber 20, additional attachment means, such as, but not limited to, chemical adhesives, electronic welding, or sewing, may also be used.

Figure 5:
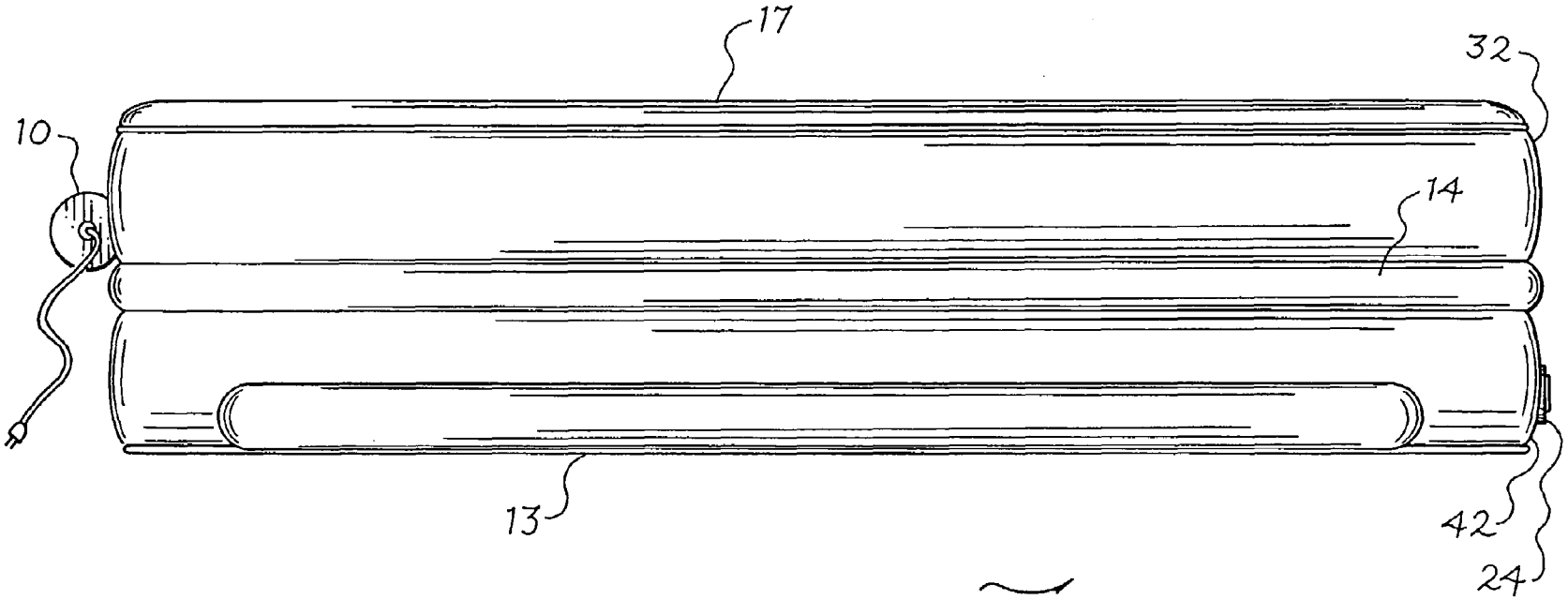
FIG. 5 is a side planar view of a mattress embodiment of the present invention.

FIG. 4 is a rear planar view of a mattress embodiment of the present invention which highlights valve 24. In the embodiment illustrated in FIG. 4, valve 24 is located substantially in the center of lower support chamber 21 at the end opposite from which pump 10 is attached to upper support chamber 20. This arrangement is preferred, as it allows the weight of the support system to force air through valve 24. This, in turn, allows the support system to be quickly deflated for storage. The arrangement of valve 24 with respect to pump 10 is more clearly illustrated in FIG. 5.

FIG. 7 is an alternative perspective view of a mattress embodiment of the present invention, illustrating the use of multiple upper support chambers 20. In the embodiment illustrated in FIG. 7, the upper support chambers 20 can be in fluid communication with the lower support chamber 21. In an alternative embodiment, the upper support chambers 20 may be separately inflatable, allowing users to select a desired firmness for each upper support chamber. In this embodiment, air from pump 10 may be redirected into either or both the upper support chambers 20 by enabling or disabling one or more valves 26 connected to each chamber (illustrated in FIG. 3).

FIG. 9 is a cross-sectional view of the mattress embodiment of the present invention illustrated in FIG. 4 with the addition of a pillow-top chamber 29. In this embodiment, the pillow-top chamber 27 does not have a side gusset, which results in a rounded outer edge 28. In addition, the pillow-top chamber 27 has dimensions substantially equal to those of the upper support chamber 20. The pillow-top chamber 27 can also be welded to give it a quilted appearance, and it can be covered with flocking or other material to provide a velvety soft texture. Through the addition of such a pillow-top chamber 27, support system as a whole can more closely approximate the look and feel of a traditional bed.

Through the arrangements set forth above, the present invention provides an increased height support system that yields increased comfort, added stability, and improved structural integrity over the prior art.

It should be noted that there could be a wide range of changes made to the present embodiments without departing from the scope of the claimed invention. For example, more support chambers could be added, the size of the chambers could be changed, and other types of inflation methods could be utilized. It is therefore intended that the foregoing detailed description be regarded as illustrative rather than limiting, and that it be understood that it is the following claims, including all equivalents, that are intended to define the spirit and scope of this invention.

What is claimed is:

1. An inflatable mattress comprising:

a support system comprising an upper and a lower inflatable support chamber arranged in a substantially vertical manner, each inflatable support chamber having a top layer, a bottom layer and a side gusset; and at least one inflatable stabilizing component, said stabilizing component being attached at said bottom layer of said lower inflatable support chamber, and being of a height less than the height of said lower inflatable support chamber.

2. The inflatable mattress of claim 1, wherein said stabilizing component is in fluid communication with said lower inflatable support chamber.

3. The inflatable mattress of claim 2, wherein said top layer of said lower inflatable support chamber is substantially aligned with said bottom layer of said upper inflatable support chamber.

4. The inflatable mattress of claim 3, wherein said upper inflatable support chamber is in fluid communication with said lower inflatable support chamber.

5. The inflatable mattress of claim 4, wherein said fluid communication is provided by an opening defined in said top layer of said lower inflatable support chamber substantially aligned with an opening defined in said bottom layer of said upper inflatable support chamber.

6. The inflatable mattress of claim 5, further comprising an inflatable reinforcing chamber, said inflatable reinforcing chamber being attached to said side gusset of at least one of said upper and said lower inflatable support chambers.

7. The inflatable mattress of claim 6, wherein said inflatable reinforcing chamber is in fluid communication with at least one of said upper and said lower inflatable support chambers.

8. An inflatable mattress comprising:

a support system comprising an upper and a lower inflatable support chamber arranged in a substantially vertical manner, each inflatable support chamber having a top layer, a bottom layer and a side gusset; and at least one inflatable stabilizing component, said stabilizing component being attached at said side gusset of said lower inflatable support chamber, and being of a height less than the height of said lower inflatable support chamber.

9. An inflatable mattress comprising:

a support system comprising an upper and a lower inflatable support chamber arranged in a substantially vertical manner, each inflatable support chamber having a top layer, a bottom layer and a side gusset, said top layer of said lower inflatable support chamber being substantially aligned with said bottom layer of said upper inflatable support chamber;

said upper inflatable support chamber being in fluid communication with said lower inflatable support chamber through an opening defined in said top layer of said lower inflatable support chamber substantially aligned with an opening defined in said bottom layer of said upper inflatable support chamber; and at least one inflatable stabilizing component, said stabilizing component being attached at said bottom layer of said lower inflatable support chamber and in fluid communication with said lower inflatable support chamber, and being of a height less than the height of said lower inflatable support chamber.

10. The inflatable mattress of claim 9, further comprising an inflatable reinforcing chamber, said inflatable reinforcing chamber being attached to said side gusset of at least one of said upper and said lower inflatable support chambers.

11. The inflatable mattress of claim 10, wherein said inflatable reinforcing chamber is in fluid communication with at least one of said upper and said lower inflatable support chambers.

12. An inflatable mattress comprising:

a support system comprising upper and lower inflatable support chambers being arranged in a substantially vertical manner and in fluid communication with each other, said top and bottom inflatable support chambers each having a top layer, a bottom layer and a side gusset; and an inflatable reinforcing chamber attached to said upper and said lower inflatable support chambers and having a height less than the height of each of said upper and said lower inflatable support chambers; and at least one inflatable stabilizing component in fluid communication with said lower inflatable support chamber attached at or near a bottom side of said lower inflatable support chamber.

13. An inflatable mattress comprising:

a support system comprising two or more inflatable chambers, wherein each inflatable chamber comprises a plurality of elongated parallel channels that extend in a longitudinal direction and that are in fluid communication with one another;

at least one stabilizing component flexibly attached to said support system on one or more sides; and a reinforcing chamber attached to a side of said support system at a juncture between said inflatable chambers and running circumferentially around said support system.

14. An inflatable mattress comprising:

a support system comprising two or more inflatable chambers, wherein each inflatable chamber comprises a plurality of elongated parallel chambers that extend in a longitudinal direction and that are in fluid communication with one another; and a means for increasing the surface area across which weight added to said support system can be distributed, wherein said means for increasing the surface area across which weight added to said support system can be distributed is a stabilizing component of a height less than the height of said support system, said stabilizing component having a plurality of stabilizers that are separately inflatable from each other.

15. An inflatable mattress comprising:

a support system comprising upper and lower inflatable support chambers being arranged in a substantially vertical manner, said top and bottom inflatable support chambers each having a top layer, a bottom layer and a side gusset and said upper inflatable support chamber being in fluid communication with said lower inflatable support chamber;

an inflatable reinforcing chamber running circumferentially around said support system and having a height less than the height of each of said upper and said lower inflatable support chambers, said inflatable reinforcing chamber being attached to said upper and said lower inflatable support chambers and being in fluid communication with at least one of said upper and said lower chambers; and at least one inflatable stabilizing component in fluid communication with said lower inflatable support chamber and attached at or near a bottom side of said lower inflatable support chamber.

16. An inflatable mattress comprising:

a support system comprising two or more inflatable chambers, wherein each inflatable chamber comprises a plurality of elongated parallel channels that extend in a longitudinal direction and that are in fluid communication with one another; and at least one stabilizing component flexibly attached to said support system on one or more sides, said stabilizing component comprising one or more separately inflatable chambers.

17. An inflatable mattress comprising:

a support system comprising two or more inflatable chambers, wherein each inflatable chamber comprises a plurality of elongated parallel channels that extend in a longitudinal direction and that are in fluid communication with one another; and at least one stabilizing component flexibly attached to said support system on one or more sides; and a reinforcing chamber attached to a side of said support system at a juncture between said inflatable chambers.

18. The inflatable mattress of claim 17 wherein said reinforcing chamber runs circumferentially around said support system.

19. An inflatable mattress comprising:

a support system comprising two or more inflatable chambers, wherein each inflatable chamber comprises a plurality of elongated parallel chambers that extend in a longitudinal direction and that are in fluid communication with one another; and a means for increasing the surface area across which weight added to said support system can be distributed, said means being a plurality of stabilizing components each having a height less than the height of said support system and being separately inflatable from each other.

* * * * *